US010720296B1

(12) United States Patent
Liu et al.

(10) Patent No.: US 10,720,296 B1
(45) Date of Patent: Jul. 21, 2020

(54) FIELD EMISSION NEUTRALIZER COMPRISING A GRAPHITIZED CARBON NANOTUBE STRUCTURE

(71) Applicants: Tsinghua University, Beijing (CN); HON HAI PRECISION INDUSTRY CO., LTD., New Taipei (TW)

(72) Inventors: Peng Liu, Beijing (CN); Duan-Liang Zhou, Beijing (CN); Chun-Hai Zhang, Beijing (CN); Li Qian, Beijing (CN); Yu-Quan Wang, Beijing (CN); Xue-Wei Guo, Beijing (CN); Li-Yong Ma, Beijing (CN); Fu-Jun Wang, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/661,173

(22) Filed: Oct. 23, 2019

(30) Foreign Application Priority Data

Jul. 16, 2019 (CN) ..... 2019 1 0642707

(51) Int. Cl.
*H01J 19/24* (2006.01)
*H01J 19/38* (2006.01)

(52) U.S. Cl.
CPC ..... *H01J 19/24* (2013.01); *H01J 19/38* (2013.01)

(58) Field of Classification Search
CPC ..... H01J 9/025; H01J 1/304; H01J 21/00
See application file for complete search history.

(56) References Cited

U.S. PATENT DOCUMENTS 9,196,447 B2 * 11/2015 Fomani ..... H01J 1/304

* cited by examiner

*Primary Examiner* — Joseph L Williams
(74) *Attorney, Agent, or Firm* — ScienBiziP, P.C.

(57) ABSTRACT

A field emission neutralizer is provided. The field emission neutralizer comprises a bottom plate and at least one field emission cathode unit located on the bottom plate. The field emission cathode unit comprises a substrate, a shell located on the substrate, a mesh grid, a shielding layer insulated and spaced from the mesh grid, and at least one cathode emitter located inside the shell, and insulated and spaced from the mesh grid. The cathode emitter comprises two cathode electrode sheets and a graphitized carbon nanotube structure, the graphitized carbon nanotube structure comprises a first portion and a second portion, the first portion is clamped between the two cathode electrode sheets, and the second portion is exposed outside of the two cathode electrode sheets.

20 Claims, 12 Drawing Sheets

FIELD EMISSION NEUTRALIZER COMPRISING A GRAPHITIZED CARBON NANOTUBE STRUCTURE

CROSS-REFERENCE TO RELATED APPLICATIONS

This application claims all benefits accruing under 35 U.S.C. § 119 from China Patent Application No. 201910642707.5, filed on Jul. 16, 2019, in the China National Intellectual Property Administration, the contents of which are hereby incorporated by reference. The application is also related to copending applications entitled, "ION THRUSTER", filed on Oct. 23, 2019 (application Ser. No. 16/661,163). The application is also related to copending applications entitled, "FIELD EMISSION NEUTRALIZER", filed on Oct. 23, 2019 (application Ser. No. 16/661,180). The application is also related to copending applications entitled, "ION THRUSTER", filed on Oct. 23, 2019 (application Ser. No. 16/661,183).

FIELD

The present disclosure relates to a field emission neutralizer, particularly to a field emission neutralizer using a carbon nanotube structure.

BACKGROUND

A main function of the field emission neutralizer is to emit electrons, and the electrons emitted from the field emission neutralizer can neutralize positive ion charges. The field emission neutralizer is an important part of a space electric propeller; the field emission neutralizer is used to prevent accumulation of system charges by emitting electrons. Failure of the filed emission neutralizer may cause the space electric propeller to fail to start, or a voltage of the space electric propeller rises to tens of thousands of volts.

Carbon nanotubes have excellent electrical conductivity and high electron emission efficiency; thus, carbon nanotubes are suitable for cathode emitters of the field emission neutralizer. However, in conventional field emission neutralizers using carbon nanotubes as cathode emitters, a binding force between carbon nanotubes and cathode electrodes is weak, carbon nanotubes can be very easily separated from the cathode electrode during electron emissions. Further, carbon nanotubes can turn into powders easily, resulting in lower efficiency in emitting electrons and even failure to emit electrons.

BRIEF DESCRIPTION OF THE DRAWINGS

Implementations of the present technology will now be described, by way of embodiments, with reference to the attached figures, wherein.

DETAILED DESCRIPTION

Figure 1:
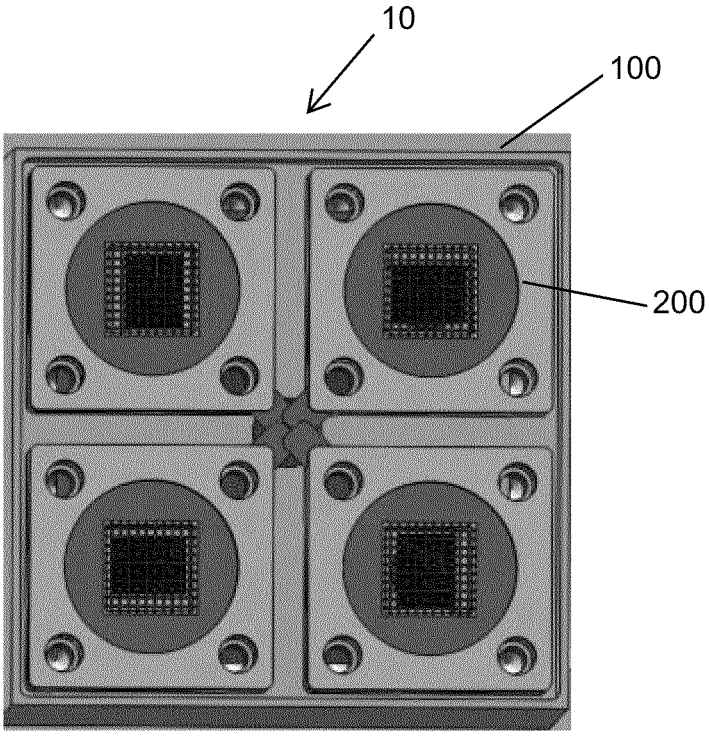
FIG. 1 is a top view schematic diagram of one embodiment of a field emission neutralizer.

The disclosure is illustrated by way of example and not by way of limitation in the figures of the accompanying drawings in which like references indicate similar elements. It should be noted that references to "another," "an," or "one" embodiment in this disclosure are not necessarily to the same embodiment, and such references mean "at least one."

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature which is described, such that the component need not be exactly or strictly conforming to such a feature. The term "comprise," when utilized, means "include, but not necessarily limited to"; it specifically indicates open-ended inclusion or membership in the so-described combination, group, series, and the like.

Figure 2:
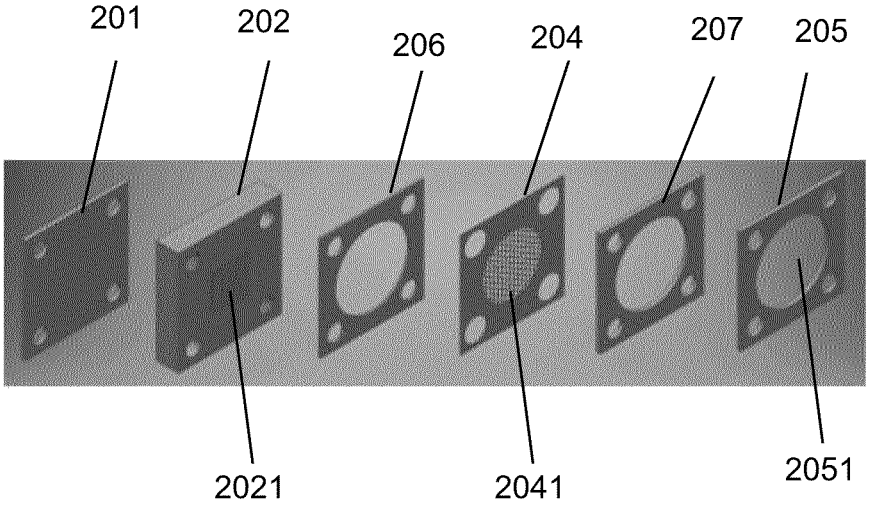
FIG. 2 is a structural disassembly diagram of one embodiment of a field emission cathode unit.
Figure 3:
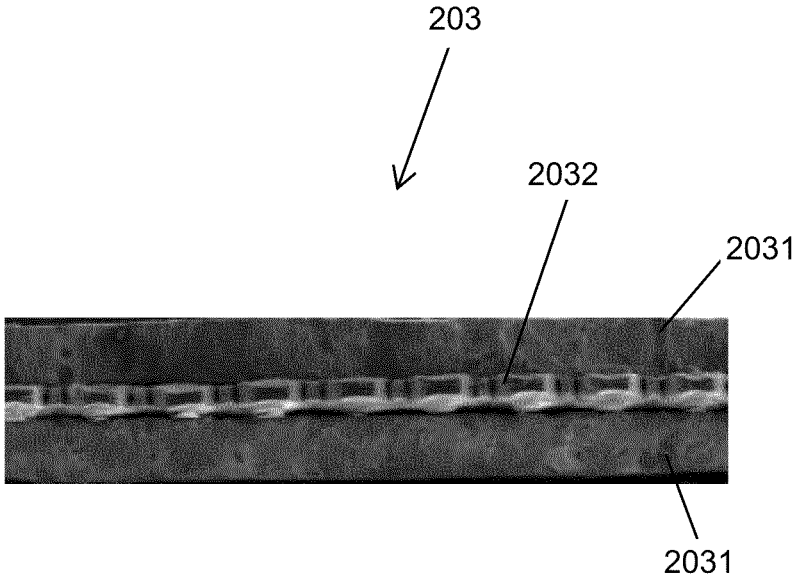
FIG. 3 is a scanning electron micrograph (SEM) image of one embodiment of a cathode emitter.

FIGS. 1-3 illustrate a field emission neutralizer 10. The field emission neutralizer 10 comprises a bottom plate 100 and at least one field emission cathode unit 200. The at least one field emission cathode unit 200 is located on the bottom plate 100. When the field emission neutralizer 10 comprises at least two field emission cathode units 200, the at least two field emission cathode units are located on the bottom plate 100 and spaced from each other.

The field emission cathode unit 200 comprises a substrate 201, a shell 202, at least one cathode emitter 203, a mesh grid 204, and a shielding layer 205. The shell 202 is located on the substrate 201. The at least one cathode emitter 203 is located inside the shell 202, and the at least one cathode emitter 203 is insulated and spaced from the mesh grid 204. The mesh grid 204 is insulated and spaced from the shielding layer 205. The shell 202 comprises an opening 2021. The mesh grid 204 comprises a plurality of gate holes 2041, and the plurality of gate holes 2041 is uniformly distributed. The shielding layer 205 comprises a first through-hole 2051. The opening 2021, the plurality of gate holes 2041, and the first through-hole 2051 communicate with each other. Electrons emitted from the at least one cathode emitter 203 are emitted through the opening 2021, the plurality of gate holes 2041, and the first through-hole 2051.

The cathode emitter 203 comprises two cathode electrode sheets 2031 and a graphitized carbon nanotube structure 2032. The two cathode electrode sheets 2031 are stacked with each other, and the graphitized carbon nanotube structure 2032 is clamped by the two cathode electrode sheets 2031. The graphitized carbon nanotube structure 2032 defines a first portion and a second portion. The graphitized carbon nanotube structure 2032 clamped between the two cathode electrode sheets 2031 is defined as the first portion. The graphitized carbon nanotube structure 2032 exposed outside of the two cathode electrode sheets 2031 is defined as the second portion. The graphitized carbon nanotube structure 2032 is an electron emitter.

The two cathode electrode sheets 2031 are welded together, the first portion of the graphitized carbon nanotube structure 2032 is clamped between the two cathode electrode sheets 2031, therefore, a combined force of the graphitized carbon nanotube structure 2032 and the cathode electrode sheet 2031 is large, the graphitized carbon nanotube structure 2032 does not separate from the cathode electrode sheet 2031 during electron emission, thereby increasing a service life of the field emission neutralizer 100. A method of welding the two cathode electrode sheets 2031 can be spot welding or laser welding. In some embodiments, the two cathode electrode sheets 2031 are combined together by spot welding, the two cathode electrode sheets 2031 are nickel sheets or stainless steel sheets. In some embodiments, the two cathode electrode sheets 2031 are combined together by laser welding, the two cathode electrode sheets 2031 are metal sheets or metal alloy sheets. In one embodiment, the bottom edges of the two cathode electrodes sheets 2031 are welded together. In one embodiment, the two cathode electrode sheets 2031 are combined together by spot welding, the two cathode electrode sheets 2031 are two nickel sheets, the two nickel sheets are small pieces formed by flattening a 100 μm thick pure nickel tube, and the first portion of the graphitized carbon nanotube structure 2032 is clamped between the two nickel sheets.

Figure 4:
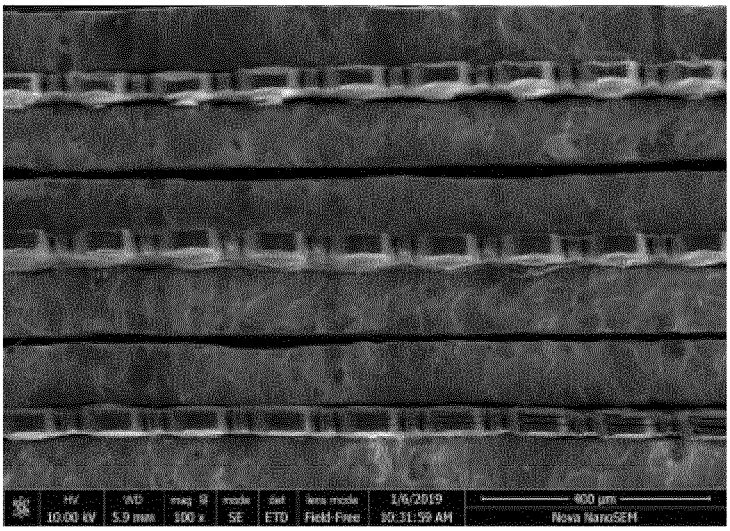
FIG. 4 is a scanning electron microscope (SEM) image of one embodiment of three cathode emitters welded together.

In one embodiment, the field emission neutralizer 10 comprises a plurality of cathode emitters 203, a plurality of cathode electrode sheets 2031 of the plurality of cathode emitters 203 are welded together. In one embodiment, the field emission neutralizer 10 comprises a plurality of cathode emitters 203, a plurality of cathode electrode sheets 2031 of the plurality of cathode emitters 203 are welded together by laser welding. FIG. 4 illustrates a field emission neutralizer 10 of one embodiment comprises three cathode emitters 203, the six cathode electrode sheets 2031 of the three cathode emitters 203 are welded together, thereby increasing the amount of electron emission and improving the emission efficiency. In some embodiments, the field emission neutralizer 10 comprises 4 to 6 cathode emitters 203 welded together. A crystallinity of the graphitized carbon nanotube structure 2032 is much larger than a crystallinity of a carbon nanotube structure without graphitization, there are almost no dislocations and defects in the microstructure of the graphitized carbon nanotube structure 2032, and the graphitized carbon nanotube structure 2032 is substantially a three-dimensional ordered graphite structure; therefore, the graphitized carbon nanotube structure 2032 has excellent electrical conductivity, thermal conductivity, mechanical properties and the like, the graphitized carbon nanotube structure 2032 can maintain its original shape during use, and will not become a powder, especially when used in a vacuum. In one embodiment, the graphitized carbon nanotube structure 2032 is obtained by graphitizing a carbon nanotube structure in an inert gas of about 2800° C.; the high temperature graphitization heat treatment can effectively improve the microstructure of the carbon nanotubes, improve the crystallinity of carbon nanotubes, and remove high temperature volatile impurities such as metal catalysts in carbon nanotube structure.

The graphitized carbon nanotube structure 2032 comprises at least one carbon nanotube film or at least one carbon nanotube wire.

In one embodiment, the graphitized carbon nanotube structure 2032 is a carbon nanotube film, a density of the carbon nanotube film is larger than or equal to 1.6 g/m$^3$. The carbon nanotube film has large density, therefore, the emission current of the electrons emitted from the cathode emitter 203 can be increased, and the volume of the cathode emitter 203 can be reduced.

In one embodiment, the carbon nanotube film is a super-aligned carbon nanotube film. The super-aligned carbon nanotube film comprises a plurality of carbon nanotubes, and the plurality of carbon nanotubes are joined together by Van der Waals forces. The extending directions of the plurality carbon nanotubes of the carbon nanotube film are substantially perpendicular to the substrate 201. An end of the carbon nanotube film comprises a plurality of burrs away from the substrate 201, the plurality of burrs are carbon nanotubes vertically protruding from the carbon nanotube film. Each of the plurality of burrs can be an erected single carbon nanotube or a bundle of carbon nanotubes formed of a plurality of carbon nanotubes. The plurality of burrs is used as a field emission tip, thus a surface area of the field emission tip is small, thereby making the local electric field more concentrated and increasing the field emission efficiency.

In one embodiment, the graphitized carbon nanotube structure 2032 consists of one carbon nanotube film. In one embodiment, the graphitized carbon nanotube structure 2032 comprises a plurality of carbon nanotube films stacked with each other. In one embodiment, the graphitized carbon nanotube structure 2032 comprises a plurality of carbon nanotube films stacked with each other, and the extending directions of the plurality of carbon nanotubes of the plurality of carbon nanotube films are all substantially perpendicular to the substrate 201. In some embodiments, the graphitized carbon nanotube structure 2032 comprises 5 to 20 carbon nanotube films.

When the graphitized carbon nanotube structure 2032 is formed by the carbon nanotube film, a thickness of the graphitized carbon nanotube structure 2032 ranges from about 1.0 millimeter to about 3.0 millimeters.

When the graphitized carbon nanotube structure 2032 is formed by the carbon nanotube film, a shape of the second portion of the graphitized carbon nanotube structure 2032 can be convex shaped, zigzag shaped, semicircular shaped, or the like, such as 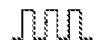 , 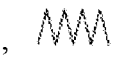 , and 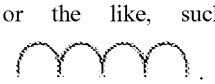 .

When the graphitized carbon nanotube structure 2032 is formed by the carbon nanotube film, a method for making the cathode emitter 203 comprises: step (a), processing a first carbon nanotube film to make a density of the first carbon nanotube film increased to larger than or equal to 1.6 g/m$^3$; step (b), graphitizing the first carbon nanotube film, to obtain a graphitized carbon nanotube film; step (c), cutting the graphitized carbon nanotube film; step (d), clamping the graphitized carbon nanotube film with two cathode electrode sheets, to hold a portion of the graphitized carbon nanotube film between the two cathode electrode sheets, and expose another portion to the outside of the two cathode electrode sheets; and welding the two cathode electrode sheets; step (e), cutting the graphitized carbon nanotube film exposed outside of the two cathode electrode sheets; step (f), ultrasonic cleaning to remove loose carbon nanotubes to obtain cathode emitter preforms; and step (g), adhering the graphitized carbon nanotube film exposed outside of the two cathode electrode sheets with a tape, to obtain the cathode emitter 203. When the field emission neutralizer 10 comprises a plurality of cathode emitters 203, the method further comprises a step of welding the plurality of cathode electrode sheets 2031 of the plurality of cathode emitters 203 together after the step (c) and before step (d).

In step (a), in one embodiment, processing the first carbon nanotube film by treating the first carbon nanotube film directly at 1400-1700° C., 40-60 MPa for 5-10 minutes. In another embodiment, treating a second carbon nanotube film at 1400-1700° C., 40-60 MPa for 5-10 min to make a density of the second carbon nanotube film increased to larger than or equal to 1.6 g/m$^3$, a thickness of the second carbon nanotube film is larger than a thickness of the first carbon nanotube film; and then, taking out a carbon nanotube film from the second carbon nanotubes for subsequent graphitization. In step (b), graphitizing the first carbon nanotube film is carried out by treating the first carbon nanotube film in an inert atmosphere at 2600-2900° C. for 1-3 hours. In step (e), cutting the graphitized carbon nanotube film exposed outside of the two cathode electrode sheets by laser. In step (g), after adhering the graphitized carbon nanotube film exposed outside of the two cathode electrode sheets by the tape, a part of the carbon nanotubes in the graphitized carbon nanotube film are pulled upright, and a plurality of burrs are formed at the edge of the graphitized carbon nanotube film. The plurality of burrs are carbon nanotubes protruding vertically from the graphitized carbon nanotube film, and each of the plurality of burrs can be an erected single carbon nanotube or a bundle of carbon nanotubes formed of a plurality of carbon nanotubes. The plurality of burrs is used as a field emission tip, a surface area of the field emission tip is small, thereby making the local electric field more concentrated and increasing the field emission efficiency.

In one embodiment, processing the first carbon nanotube film at 1600° C., 50 MPa for 5 minutes, to make the density of the first carbon nanotube film increased to larger than or equal to 1.6 g/m$^3$; treating the first carbon nanotube film in an Ar gas atmosphere at 2800° C. for 1 hour to obtain a first graphitized carbon nanotube film; cutting the first graphitized carbon nanotube film to obtain a second graphitized carbon nanotube film with a thickness of 50 μm, a width of 4 mm, and a length of 2 mm; clamping the second graphitized carbon nanotube film by two nickel sheets flattened with a 100 μm thick pure nickel tube, and spot welding the two nickel sheets; welding 6 pieces of nickel sheets with the second graphitized carbon nanotube film together; cutting the length of the second graphitized carbon nanotube film to 250 microns by a laser; ultrasonic cleaning to remove loose carbon nanotubes to obtain a cathode emitter preform; and adhering the top end of the cathode emitter preform with a tape, to obtain the cathode emitter.

Figure 5:
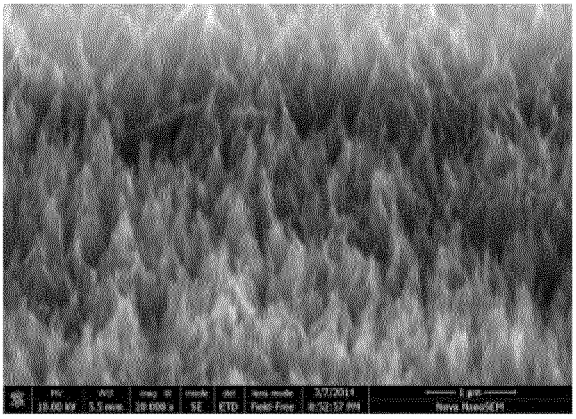
FIG. 5 is a surface topography of one embodiment of a cathode emitter preform.
Figure 6:
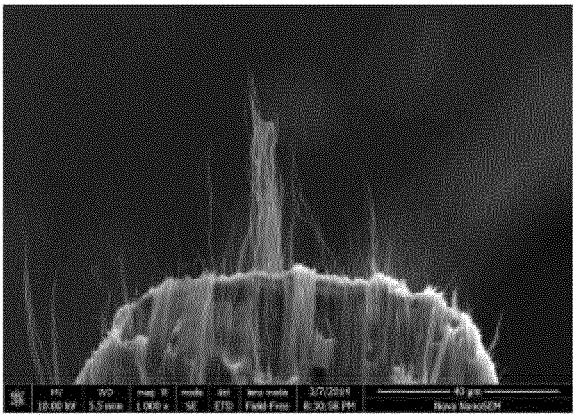
FIG. 6 is an electron micrograph of an emission tip of a cathode emitter of one embodiment.

FIG. 5 illustrates a surface topography of a cathode emitter preform of one embodiment, it can be seen that the cathode emitter preform is substantially free of loose carbon nanotubes. FIG. 6 illustrates an electron micrograph of an emission tip of a cathode emitter of one embodiment, it can be seen that the carbon nanotubes in the emission tip are vertically upward, and the emission tip of the cathode emitter has a plurality of burrs. The plurality of burrs can reduce a surface area of the field emission tip, thereby making the local electric field more concentrated and increasing the field emission efficiency.

A material of the bottom plate 100 is a conductive material, such as metal and metal alloy material. In one embodiment, the bottom plate 100 is a stainless steel plate.

A material of the substrate 201 is an insulation material, such as glass, ceramic and silica. In one embodiment, the material of the substrate 201 is ceramic. The substrate 201 is used to support the shell 202.

Figure 7:
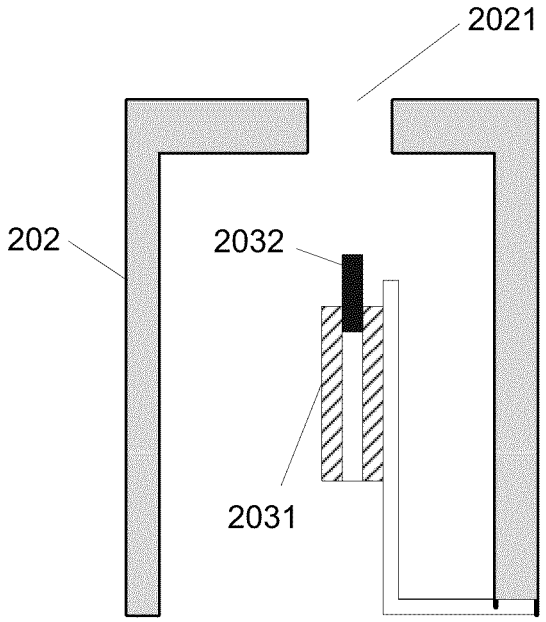
FIG. 7 is a structure schematic diagram of one embodiment of fixing a cathode emitter inside the shell.

A material of the shell 202 can be a conductive material or an insulating material. In one embodiment, the material of the shell 202 is stainless steel. The shell 202 is used to hold the cathode emitter 203, to prevent the cathode emitter 203 from being contaminated and damaged by an external force. A shape of the shell is not limited, as long as the cathode emitter 203 can be placed inside and electrons can be emitted outward through the opening 2021. Referring to FIG. 7, in one embodiment, the cathode emitter 203 is fixed inside the shell 202 by an L-shaped metal sheet. The cathode emitter 203 is fixed inside the shell 202 by welding the cathode electrode sheet 2031 on a sidewall of the L-shaped metal sheet in a vertical direction, and then, fixing a horizontal sidewall of the L-shaped metal sheet to one sidewall of the shell 202 by screws.

The cathode emitter 203 is insulated from the mesh grid 204. In one embodiment, the material of the shell 202 is conductive material, the field emission neutralizer 10 further comprises a first insulating layer 206, and the first insulating layer 206 is located between the shell 202 and the mesh grid 204. The first insulating layer 206 can be an insulating plate, or a plurality of insulators disposed between the shell 202 and the mesh grid 204. In one embodiment, the first insulating layer 206 is the insulating plate, the insulating plate comprises a second through-hole 2061, the second through hole 2061 and the opening 2021 on the shell 202 communicate with each other.

In one embodiment, the field emission neutralizer 10 further comprises a second insulating layer 207, and the second insulating layer 207 is located between the mesh grid 204 and the shielding layer 205, to make the mesh grid 204 insulated from the shielding layer 205. The second insulating layer 207 can be an insulating plate, or a plurality of insulators disposed between the mesh grid 204 and the shielding layer 205. In one embodiment, the second insulating layer 207 is the insulating plate, the insulating plate comprises a third through hole 2071, the third through hole 2071 and the plurality of gate holes 2041 on the mesh grid 204 communicate with each other.

A material of each of the first insulating layer 206 and the second insulating layer 207 can be an insulating material such as glass, ceramic or silicon dioxide. In one embodiment, the material of the first insulating layer 206 and the material of the second insulating layer 207 are both ceramics.

The substrate 201, the shell 202, the first insulating layer 206, the mesh grid 204, the second insulating layer 207, and the shielding layer 205 are sequentially stacked and fixed together. The substrate 201, the shell 202, the first insulating layer 206, the mesh grid 204, the second insulating layer 207, and the shielding layer 205 can be fixed together by adhesive, welding, or screws. In one embodiment, the substrate 201, the shell 202, the first insulating layer 206, the mesh grid 204, the second insulating layer 207, and the shielding layer 205 are fixed together by screws.

In one embodiment, the mesh grid 204 is a metal mesh structure. The mesh grid 204 comprises the plurality of gate holes 2041 uniformly distributed, and electrons emitted from the graphitized carbon nanotube structure 2032 can be emitted outside through the plurality of gate holes 2041. In some embodiments, a distance between the mesh grid 204 and the cathode emitter 203 ranges from 100 micrometers to 200 micrometers. In one embodiment, the mesh grid 204 is a square molybdenum mesh, and a distance between the square molybdenum mesh and the cathode emitter 203 is about 150 micrometers.

A material of the shielding layer 205 is a conductive material, such as metal or metal alloy. In one embodiment, the shielding layer 205 is a stainless steel plate.

In one embodiment, the field emission neutralizer 10 further comprises a conductive layer (not shown), the conductive layer is located between the substrate 201 and the shell 202, and the conductive layer is in contact with the sidewall of the L-shaped metal sheet in the vertical direction. A first electrode wire is connected to the conductive layer to supply a voltage to the cathode electrode sheets 2031. A second electrode wire is connected to the mesh grid 204 to supply a voltage to the mesh grid 204. The conductive layer can be selected, as long as the voltage can be supplied to the two cathode electrode sheets 2031 through the electrode wire. In one embodiment, the first electrode wire is directly connected to the L-shaped metal sheet. In one embodiment, the first electrode wire is directly connected to the shell 202.

When the field emission neutralizer 10 is applied, different voltages are applied to the cathode electrode sheet 2031 and the mesh grid 204, respectively, a voltage difference can be formed between the cathode electrode sheet 2031 and the mesh grid 204; the electrons emitted from the graphitized carbon nanotube structure 2032 move toward the mesh grid 205 under an action of an electric field, and then are emitted through the first through-hole 2051 of the shielding layer 205.

Figure 8:
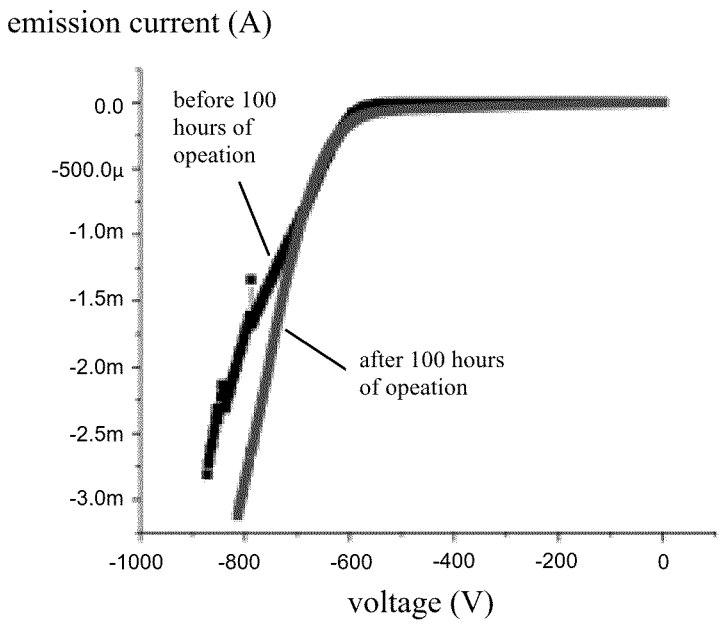
FIG. 8 is curves of emission current versus voltage of one embodiment of a field emission neutralizer.
Figure 9:
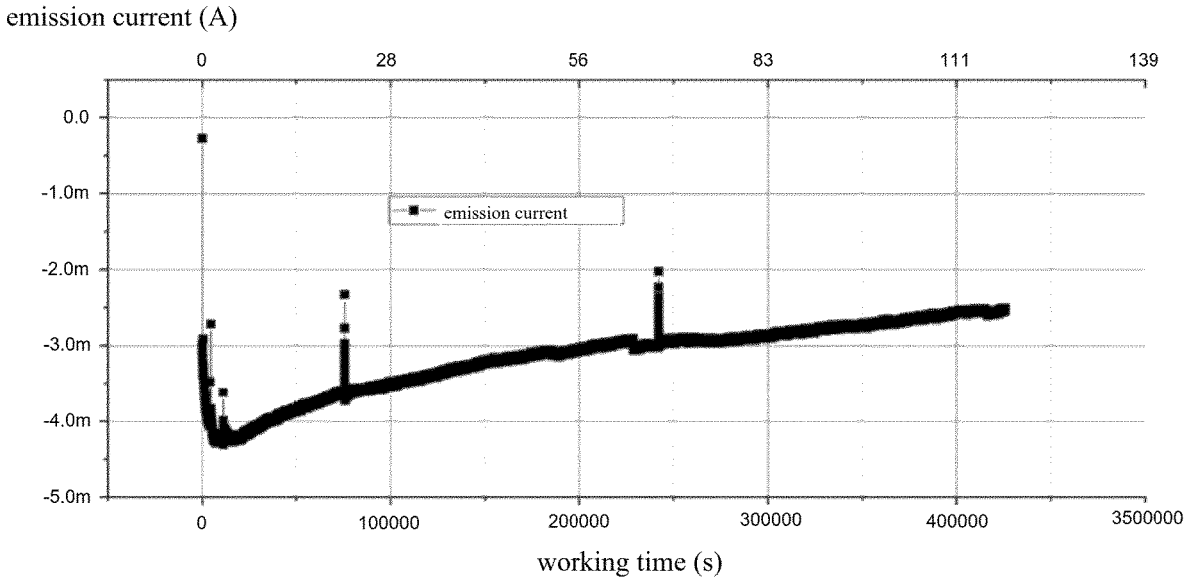
FIG. 9 is curves of emission current versus working time of one embodiment of a field emission neutralizer.

FIG. 8 illustrates curves of the emission current versus voltage of the field emission neutralizer 10. It can be seen that after the field emission neutralizer 10 operates for 100 hours, the emission current-voltage curve of the field-current neutralizer 10 is substantially consistent with the emission current-voltage curve before 100 hours of operation. FIG. 9 illustrates curves of the emission current versus working time of the field emission neutralizer 10. It can be seen that the electron emission current of the field emission neutralizer 10 changes little with the working time. FIG. 8 and FIG. 9 illustrate that the field emission neutralizer 10 has high efficiency in emitting electrons, and the emission characteristics of the field emission neutralizer 10 change little with the working time.

Figure 10:
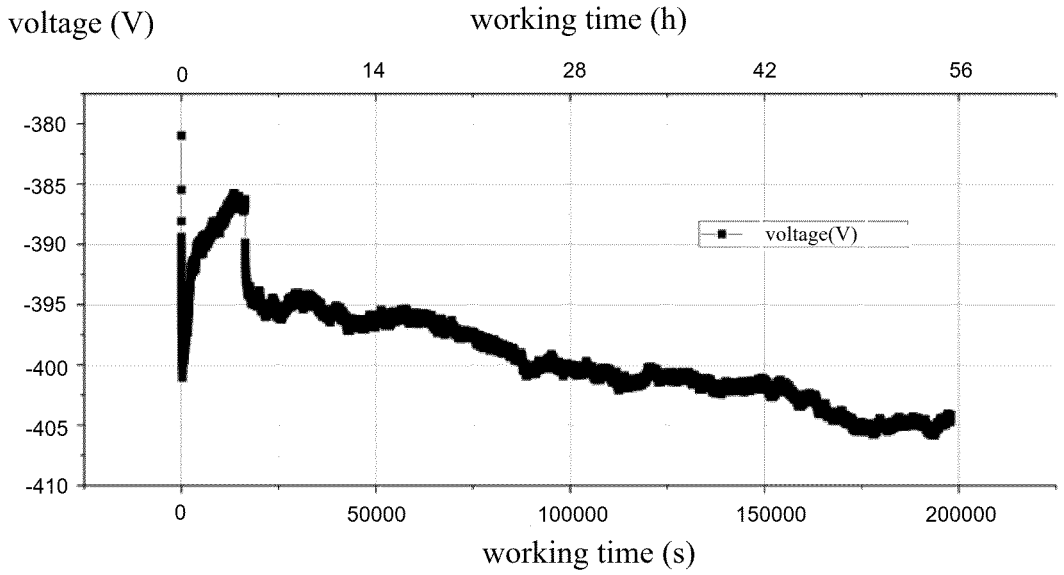
FIG. 10 is curves of applied voltage versus working time of one embodiment of a field emission neutralizer.

Referring to FIG. 10, it can be seen that the voltage applied to the field emission neutralizer 10 changes little with the working time, which illustrates that the field emission neutralizer 10 has excellent emission stability.

Figure 11:
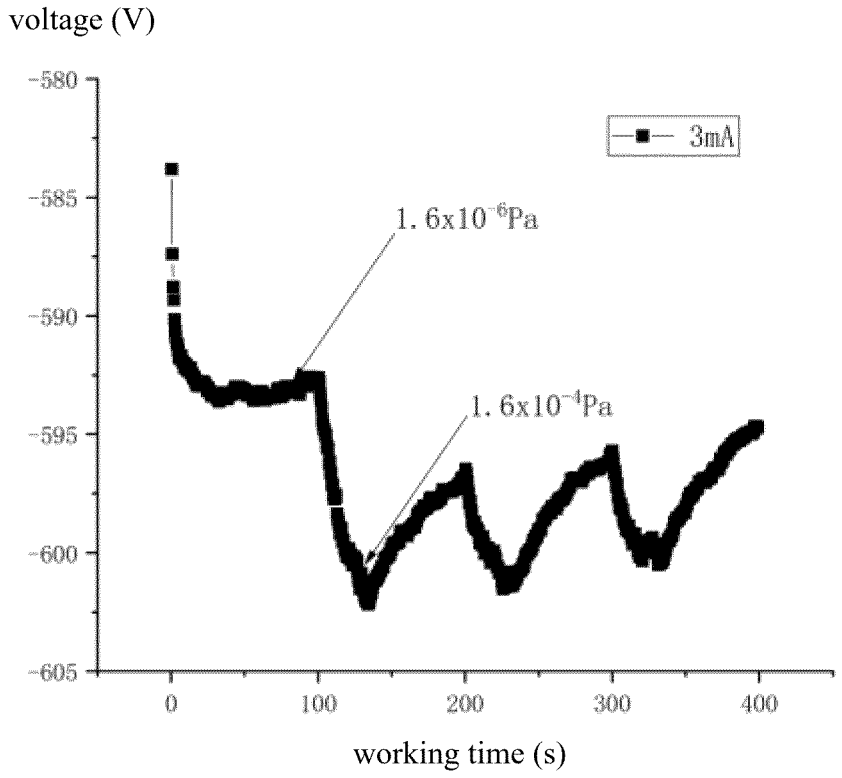
FIG. 11 is curves of voltage versus working time of a field emission neutralizer under different vacuum degrees.

Referring to FIG. 11, when the vacuum is $1.6\times10^{-6}$ Pa and the emission current is 3 mA, the voltage changes little with the working time, which illustrates that the field emission neutralizer has excellent emission stability in a vacuum of $1.6\times10^{-6}$ Pa.

In one embodiment, a carbon deposit layer is uniformly coated on a surface of the graphitized carbon nanotube structure 2302, the carbon deposit layer can increase a mechanical property of the graphitized carbon nanotube structure 2302; thereby increasing the emission stability of the field emission neutralizer 10.

Figure 12:
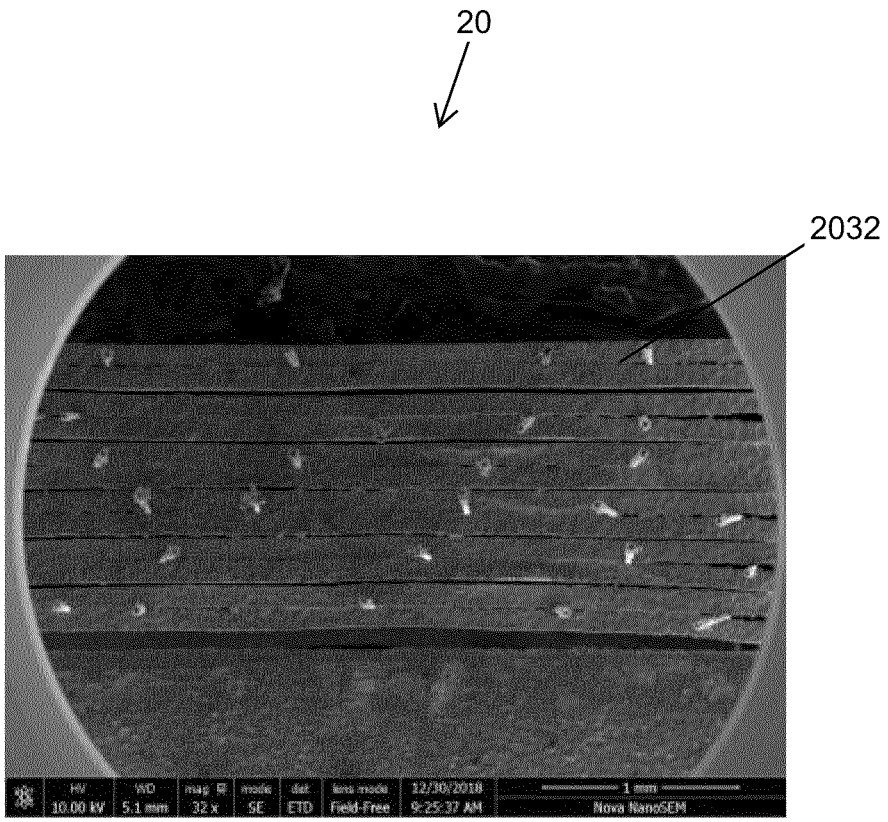
FIG. 12 is a scanning electron microscope (SEM) image of one embodiment of a cathode emitter.

FIG. 12 illustrates a field emission neutralizer 20 of one embodiment. The field emission neutralizer 20 is substantially the same as the field emission neutralizer 10, except that the graphitized carbon nanotube structure 2032 comprises at least one carbon nanotube wire.

The carbon nanotube wire comprises a first end and a second end, and the carbon nanotubes in the carbon nanotube wire extend from the first end to the second end. The first end is clamped between the two cathode electrode sheets 2031, and the second end is exposed outside from the two cathode electrode sheet 2031 as an electron transmitting end.

Each of the at least one carbon nanotube wire can be an untwisted carbon nanotube wire or a twisted carbon nanotube wire. Examples of carbon nanotube wire are taught by U.S. Pat. No. 7,045,108 to Jiang et al., and U.S. Pat. No. 8,602,765 to Jiang et al.

In one embodiment, the graphitized carbon nanotube structure 2032 consists of one carbon nanotube wire. In some embodiments, the graphitized carbon nanotube structure 2032 comprises a plurality of carbon nanotube wires, the plurality of carbon nanotube wires can be spaced apart from each other, the plurality of carbon nanotube wires can be arranged in parallel to form a carbon nanotube bundle, the plurality of carbon nanotube wires can also be spirally wound together along the axial direction of the carbon nanotube wire. In one embodiment, the field emission cathode unit 200 comprises six cathode emitters 203, the cathode electrode sheets 2301 of the six cathode emitters are welded together, the graphitized carbon nanotube structure 2032 of each cathode emitter 203 comprises five untwisted carbon nanotube wires spaced from each other, and each field emission cathode unit 200 comprises 30 untwisted carbon nanotube wires spacing from each other.

In some embodiments, a diameter of the carbon nanotube wire ranges from about 2 micrometers to about 500 micrometers. A length of the carbon nanotube wire ranges from about 1 millimeter to about 20 millimeters. In one embodiment, the diameter of the carbon nanotube wire is 50 micrometers, and the length of the carbon nanotube wire is 5 millimeters.

In one embodiment, a method for making the cathode emitter 203 comprises: graphitizing a carbon nanotube wire to form a graphitized carbon nanotube wire; clamping the graphitized carbon nanotube wire with the two cathode electrode sheets 2031, to make one end of the graphitized carbon nanotube wire clamped between the two cathode electrode sheets 2031, and the other end exposed outside from the two cathode electrode sheet 2031 as an electron transmitting end; and welding the two cathode electrode sheets 2031 together.

In one embodiment, the field emission neutralizer 20 comprises a plurality of cathode emitters 203; the method further comprises a step of welding the plurality of cathode electrode sheets 2031 of the plurality of cathode emitters 203 together.

In one embodiment, the carbon nanotube wire is treated in an Ar gas atmosphere at 2800° C. for 1 hour to obtain the graphitized carbon nanotube wire.

The field emission neutralizer provided by the invention has the following advantages: first, the electron emission structure in cathode emitter is the graphitized carbon nanotube structure, there are almost no dislocations and defects in the microstructure of the graphitized carbon nanotube structure 2032, the graphitized carbon nanotube structure has excellent mechanical property, the graphitized carbon nanotube structure can maintain its original shape during use, and will not become a powder, especially when used in a vacuum. Second, the two cathode electrode sheets of the cathode emitter are welded together, the first portion of the graphitized carbon nanotube structure is clamped between the two cathode electrode sheets, therefore, a combined force of the graphitized carbon nanotube structure and the cathode electrode sheet is large, the graphitized carbon nanotube structure does not separate from the cathode electrode sheet during electron emission, thereby increasing a service life of the field emission neutralizer. Third, the graphitized carbon nanotube structure 2032 is a carbon nanotube film, a density of the carbon nanotube film is greater than or equal to 1.6 g/m$^3$. The carbon nanotube film has large density, therefore, the emission current of the electrons emitted from the cathode emitter can be increased, and the volume of the cathode emitter can be reduced. Further, one end of the carbon nanotube film comprises a plurality of burrs away from the substrate, the plurality of burrs is used as a field emission tip, a surface area of the field emission tip is small, thereby making the local electric field more concentrated and increasing the field emission efficiency.

It is to be understood that the above-described embodiments are intended to illustrate rather than limit the present disclosure. Variations may be made to the embodiments without departing from the spirit of the present disclosure as claimed. Elements associated with any of the above embodiments are envisioned to be associated with any other embodiments. The above-described embodiments illustrate the scope of the present disclosure but do not restrict the scope of the present disclosure.

Depending on the embodiment, certain of the steps of a method described may be removed, others may be added, and the sequence of steps may be altered. The description and the claims drawn to a method may include some indication in reference to certain steps. However, the indication used is only to be viewed for identification purposes and not as a suggestion as to an order for the steps.

What is claimed is:

1. A field emission neutralizer comprising a bottom plate; and at least one field emission cathode unit located on the bottom plate, each of the at least one field emission cathode unit comprising:

a substrate;

a shell located on the substrate and comprising an opening;

a mesh grid comprising a plurality of gate holes;

a shielding layer insulated and spaced from the mesh grid, and comprising a through-hole, wherein the opening, the plurality of gate holes, and the through-hole communicate with each other; and at least one cathode emitter located inside the shell, and insulated and spaced from the mesh grid, wherein each of the at least one cathode emitter comprises two cathode electrode sheets and a graphitized carbon nanotube structure, the graphitized carbon nanotube structure defines a first portion and a second portion, the first portion is clamped between the two cathode electrode sheets, and the second portion is exposed outside of the two cathode electrode sheets.

2. The field emission neutralizer of claim 1, wherein the graphitized carbon nanotube structure comprises at least one carbon nanotube film.

3. The field emission neutralizer of claim 2, wherein a density of each of the at least one carbon nanotube film is larger than or equal to 1.6 g/m$^3$.

4. The field emission neutralizer of claim 2, wherein the at least one carbon nanotube film comprises a plurality of carbon nanotubes, and extending directions of the plurality carbon nanotubes of the carbon nanotube film are substantially perpendicular to the substrate.

5. The field emission neutralizer of claim 2, wherein an end of the carbon nanotube film comprises a plurality of burrs extending away from the substrate, the plurality of burrs are carbon nanotubes vertically protruding from the carbon nanotube film, and the plurality of burrs is a field emission tip.

6. The field emission neutralizer of claim 2, wherein the graphitized carbon nanotube structure comprises 5 to 20 carbon nanotube films, and each of the carbon nanotube films is made of carbon nanotubes which are super aligned.

7. The field emission neutralizer of claim 2, wherein a thickness of the graphitized carbon nanotube structure ranges from approximately 1.0 millimeter to approximately 3.0 millimeters.

8. The field emission neutralizer of claim 2, wherein a shape of the second portion of the graphitized carbon nanotube structure is convex shaped, zigzag shaped, or semicircular shaped.

9. The field emission neutralizer of claim 1, wherein the graphitized carbon nanotube structure comprises at least one carbon nanotube wire comprising a plurality of carbon nanotubes.

10. The field emission neutralizer of claim 9, wherein each of the carbon nanotube wires defines a first end and a second end, and the plurality of carbon nanotubes of the carbon nanotube wire extend from the first end to the second end, the first end is clamped between the two cathode electrode sheets, and the second end is exposed outside from the two cathode electrode sheets.

11. The field emission neutralizer of claim 9, wherein the graphitized carbon nanotube structure comprises a plurality of carbon nanotube wires, the plurality of carbon nanotube wires are spaced apart from each other.

12. The field emission neutralizer of claim 9, wherein a diameter of each of the at least one carbon nanotube wire ranges from approximately 2 micrometers to approximately 500 micrometers, and a length of each of the at least one carbon nanotube wire ranges from approximately 1 millimeter to approximately 20 millimeters.

13. The field emission neutralizer of claim 1, wherein the two cathode electrode sheets are welded together.

14. The field emission neutralizer of claim 1, comprising a plurality of cathode emitters, wherein a plurality of cathode electrode sheets of the plurality of cathode emitters are welded together.

15. The field emission neutralizer of claim 1, wherein the at least one cathode emitter is fixed inside the shell by an L-shaped metal sheet.

16. The field emission neutralizer of claim 15, wherein the two cathode electrode sheets of each of the cathode emitter are welded on a vertical sidewall of the L-shaped metal sheet, and a horizontal sidewall of the L-shaped metal sheet is fixed to a sidewall of the shell by screws.

17. The field emission neutralizer of claim 16, further comprising a conductive layer, wherein the conductive layer is located between the substrate and the shell, and the conductive layer is in contact with the vertical sidewall of the L-shaped metal sheet.

18. The field emission neutralizer of claim 1, wherein a material of the shell is electrically conductive, the field emission neutralizer further comprises a first insulating layer located between the shell and the mesh grid.

19. The field emission neutralizer of claim 1, further comprising a second insulating layer located between the mesh grid and the shielding layer, and the second insulating layer electrically insulating the mesh grid from the shielding layer.

20. The field emission neutralizer of claim 1, further comprising a carbon deposit layer coated on a surface of the graphitized carbon nanotube structure.

* * * * *